US012805599B2

(12) United States Patent
Wölfel et al.

(10) Patent No.: US 12,805,599 B2
(45) Date of Patent: Nov. 24, 2026

(54) SOLE STRUCTURE WITH BANKING EFFECT

(71) Applicant: adidas AG, Herzogenaurach (DE)

(72) Inventors: Bastian Wölfel, Herzogenaurach (DE); Meng Zhao, Herzogenaurach (DE); Marc Norridge, Fuerth (DE); Hans-Peter Nuernberg, Gutenstetten (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/988,108

(22) Filed: Dec. 19, 2024

(65) Prior Publication Data

US 2025/0204638 A1 Jun. 26, 2025

(30) Foreign Application Priority Data

Dec. 22, 2023 (DE) ..... 10 2023 136 525.8

(51) Int. Cl.
*A43B 13/14* (2006.01)

(52) U.S. Cl.
CPC ..... *A43B 13/14* (2013.01)

(58) Field of Classification Search
CPC ... A43B 13/141; A43B 13/188; A43B 13/186; A43B 13/125; A43B 13/42; A43B 13/145; A43B 5/001; A43B 7/1415; A43B 7/142; A43B 7/14; A63B 69/3673
See application file for complete search history.

(56) References Cited

U.S. PATENT DOCUMENTS 1,690,837 A * 11/1928 Rehle ..... A43B 7/142 36/168
1,998,921 A * 4/1935 Brown ..... A43B 5/18 36/7.7
3,782,011 A * 1/1974 Fisher ..... A43C 15/168 36/134
3,951,407 A * 4/1976 Calacurcio ..... A63B 69/3673 36/62
4,037,847 A * 7/1977 Lorang ..... A63B 69/3608 473/269
4,342,158 A * 8/1982 McMahon ..... A43B 21/30 36/35 B
4,407,079 A * 10/1983 Chiroff ..... A63B 69/3608 473/217

(Continued)

FOREIGN PATENT DOCUMENTS

DE 102 44 433 A1 4/2004
DE 102 44 435 A1 4/2004

(Continued)

*Primary Examiner* — Jillian K Pierorazio
(74) *Attorney, Agent, or Firm* — Sterne, Kessler, Goldstein & Fox P.L.L.C.

(57) ABSTRACT

The present disclosure relates to a sole structure for a shoe, wherein the sole structure comprises a slider element configured to slide in a transverse direction of the sole structure, wherein the slider element is configured to slide towards a medial side of the sole structure when pressure is applied to a lateral portion of the sole structure and, wherein the slider element is configured to slide towards a lateral side of the sole structure when pressure is applied to a medial portion of the sole structure.

19 Claims, 3 Drawing Sheets

(56) References Cited

U.S. PATENT DOCUMENTS

| | | | | |
|---|---|---|---|---|
| 5,224,810 | A * | 7/1993 | Pitkin | A43B 13/14 36/25 R |
| 5,377,431 | A * | 1/1995 | Walker | A43C 15/168 36/134 |
| 5,881,478 | A * | 3/1999 | McMahon | A43B 13/181 36/31 |
| 7,654,014 | B1 * | 2/2010 | Moore | A43B 5/001 36/134 |
| 8,151,485 | B2 * | 4/2012 | Hurd | A43B 13/184 36/103 |
| 9,756,904 | B2 | 9/2017 | Orand | |
| 9,833,038 | B2 | 12/2017 | Foxen et al. | |
| 11,445,784 | B2 * | 9/2022 | Brown | A43B 13/16 |
| 2004/0040183 | A1 * | 3/2004 | Kerrigan | A43B 7/142 36/144 |
| 2006/0032088 | A1 * | 2/2006 | Manz | A43B 13/125 36/28 |
| 2006/0032092 | A1 * | 2/2006 | Drollinger | A43B 3/0042 36/134 |
| 2009/0272011 | A1 * | 11/2009 | Drollinger | A43B 3/0042 36/134 |
| 2009/0313858 | A1 * | 12/2009 | Andriacchi | A61F 5/0127 36/140 |
| 2015/0013194 | A1 * | 1/2015 | Hofmann | A43C 15/164 12/146 B |
| 2016/0007684 | A1 * | 1/2016 | Farris | A43B 23/0265 36/12 |
| 2016/0058122 | A1 * | 3/2016 | Foxen | A43B 13/181 36/28 |
| 2016/0270475 | A1 * | 9/2016 | Foxen | A43B 13/42 |
| 2017/0049183 | A1 * | 2/2017 | Foxen | A43B 13/12 |
| 2018/0185731 | A1 * | 7/2018 | Glancy | A43C 15/168 |
| 2020/0100562 | A1 * | 4/2020 | Brown | A43B 13/186 |
| 2023/0142549 | A1 * | 5/2023 | Dunning | A43B 13/125 36/25 R |

FOREIGN PATENT DOCUMENTS

| | | | |
|---|---|---|---|
| DE | 10 2013 202 306 | A1 | 8/2014 |
| DE | 10 2013 202 353 | A1 | 8/2014 |
| EP | 4 176 753 | A1 | 5/2023 |
| EP | 4 268 659 | A1 | 11/2023 |
| JP | 2005-224335 | A | 8/2005 |

* cited by examiner

SOLE STRUCTURE WITH BANKING EFFECT

CROSS REFERENCE TO RELATED APPLICATIONS

This application claims priority to German Patent Application No. 10 2023 136 525.8, filed Dec. 22, 2023, which is incorporated by reference herein in its entirety.

TECHNICAL FIELD

The present disclosure relates to a sole structure for a shoe and to a shoe.

BACKGROUND

For many kinds of sports and in various training drills, cut movements (for example, movements that involve a quick change of direction) are essential. A cut movement may also include acceleration in a mainly lateral or medial direction. Popular examples of cut movements are v-cuts in basketball or soccer, skater jumps in coordination and endurance training and, more generally, side-shuffle movements.

The performance of cut movements is mainly limited due to injury preventive mechanisms. In particular, cut movements may lead to excessive inversion moments at the ankle joint caused by disadvantageous misalignment of foot and shank segment and, if the ankle joint is close to the limit of its range of motion, the ankle ligaments may be prone to injury.

Such a misalignment may be counteracted by creating a banking, which leads to an improved foot shank alignment and keeps the ankle joint out of dangerous positions, thus increasing the performance and the risk of injury. This protective mechanism has been termed banking effect and leads to an increased performance especially during cut movements.

Attempts have been made to manufacture footwear that provides the banking effect. However, such attempts have not provided enough support for the ankle joint (for example, by allowing ankle inversion that could lead to injury, creating instability in other movement directions, etc.).

Hence, the problem underlying the present disclosure is to provide an improved sole structure which reduces the disadvantages discussed above.

BRIEF SUMMARY

The present disclosure is directed to a sole structure for a shoe. The sole structure may comprise a slider that is configured to slide between a medial side and a lateral side of the sole structure in a direction opposite a pressure applied to the sole structure. In this manner, embodiments according to the present disclosure provide an improved sole structure that can provide a banking effect for the user. In particular, the sole structure described herein may provide a relatively large tilting angle, while at the same time providing provide a minimal risk of tilting of the ankle or injury in general, while further using the limited available vertical space optimally.

A first embodiment (I) of the present disclosure is directed to a sole structure for a shoe, wherein the sole structure comprises: a slider element configured to slide in a transverse direction of the sole structure, wherein the slider element is configured to slide towards a medial side of the sole structure when pressure is applied to a lateral portion of the sole structure and, wherein the slider element is configured to slide towards a lateral side of the sole structure when pressure is applied to a medial portion of the sole structure.

In a second embodiment (II), in the sole structure of the first embodiment (I), the sole structure is configured such that a thickness of the medial portion of the sole structure increases when the slider element slides towards the medial side of the sole structure, and wherein the sole structure is configured such that a thickness of the lateral portion of the sole structure increases when the slider element slides towards the lateral side of the sole structure.

In a third embodiment (III), in the sole structure of any one of embodiments (I)-(II), the sliding of the slider element causes a top surface of the sole structure to tilt with respect to a lower surface of the sole structure.

In a fourth embodiment (IV), the sole structure of any one of embodiments (I)-(III) comprises a foot support element configured to interact with the slider element, such that the slider element slides towards the medial side of the sole structure when pressure is applied to a lateral portion of the foot support element and such that the slider element slides towards the lateral side of the sole structure when pressure is applied to a medial portion of the foot support element.

In a fifth embodiment (V), the sole structure of any one of embodiments (I)-(IV) comprises at least one gliding surface which is tilted relative to a horizontal plane defined by the sole structure; and at least one pressure element which is configured to interact with the gliding surface such that the slider element is caused to slide when pressure is applied to the sole structure.

In a sixth embodiment (VI), in the sole structure of the fifth embodiment (V), at least one end of the slider element comprises a gliding surface or a pressure element.

In a seventh embodiment (VII), the sole structure of any one of embodiments (IV)-(VI) comprises a ground facing element, wherein the slider element is sandwiched between the ground facing element and the foot support element.

In an eighth embodiment (VIII), in the sole structure of the seventh embodiment (VII), at least portions of at least one of the lateral or medial edges of the ground facing element and the foot support element are unconnected and movable relative to each other.

In a ninth embodiment (IX), in the sole structure of any one of embodiments (VII)-(VIII), at least one of the ground facing element or the foot support element comprises a gliding surface.

In a tenth embodiment (X), in the sole structure of any one of embodiments (I)-(IX), the slider element is arranged in a forefoot portion of the sole structure corresponding to metatarsal fat pads.

In an eleventh embodiment (XI), in the sole structure of any one of embodiments (VII)-(X), the ground facing element comprises at least one cleat.

In a twelfth embodiment (XII), in the sole structure of the eleventh embodiment (XI), the slider element is arranged in an overlapping manner with the at least one cleat.

In a thirteenth embodiment (XIII), the sole structure of any one of embodiments (I)-(XII) comprises an upper gliding element and/or a lower gliding element, wherein the upper gliding element and/or the lower gliding element is configured to interact with the slider element.

In a fourteenth embodiment (XIV), in the sole structure of the thirteenth embodiment (XIII), the upper gliding element and/or the lower gliding element comprise at least one gliding surface which is tilted relative to a horizontal plane defined by the sole structure and configured to interact with a gliding surface or a pressure element of the slider element such that the slider element is caused to slide when pressure is applied to the sole structure.

In a fifteenth embodiment (XV), in the sole structure of any one of embodiments (XIII)-(XIV), the upper gliding element and/or the lower gliding element comprise at least one pressure element which is configured to interact with a gliding surface of the slider element such that the slider element is caused to slide when pressure is applied to the sole structure.

In a sixteenth embodiment (XVI), the sole structure of any one of embodiments (XIII)-(XV) comprises a pivot point, wherein the upper gliding element is connected to the lower gliding element at the pivot point.

In a seventeenth embodiment (XVII), in the sole structure of the sixteenth embodiment (XVI), the pivot point is realized by a screw and a nut.

In an eighteenth embodiment (XVIII), in the sole structure of any one of embodiments (XVI)-(XVII), the pivot point is located more proximal to a medial side of the sole structure than to a lateral side.

In a nineteenth embodiment (XIX), in the sole structure of any one of embodiments (XVI)-(XVIII), the slider element comprises an aperture, and wherein the pivot point is arranged at least partially in the aperture.

In a twentieth embodiment (XX), in the sole structure of any one of embodiments (III)-(XIX), the tilting of the top surface of the sole structure with respect to a lower surface of the sole structure defines a tilting angle, wherein a maximum tilting angle is greater than or equal to 5 degrees and less than or equal to 10 degrees.

In a twenty-first embodiment (XXI), the sole structure of any one of embodiments (III)-(XX) is configured such that a tilting in only one of a medial direction or a lateral direction is possible. In some embodiments, the only one direction is the medial direction.

In a twenty-second embodiment (XXII), in the sole structure of any of embodiments (VI)-(XXI), a first end of the slider element comprises a first gliding surface and a second end of the slider element comprises a second gliding surface, wherein the first gliding surface is essentially flat and, wherein the second gliding surface comprises a concave shape.

In a twenty-third embodiment (XXIII), in the sole structure of any one of embodiments (I)-(XXII), the slider element comprises one or more of nylon, polyoxymethylene, polytetrafluoroethylene, polyamide-imide, polyetherimide, polyether ether ketone, or polyamide, or a combination thereof.

In a twenty-fourth embodiment (XIV), a shoe comprises the sole structure of any one of embodiments (I)-(XXIII); and an upper coupled to the sole structure.

In a twenty-fifth embodiment (XXV), in the shoe of the twenty-fourth embodiment (XXIV), the upper is coupled to either the foot support element or the ground facing element.

In a twenty-sixth embodiment (XXVI), in the shoe of the twenty-fourth embodiment (XXIV), the upper is coupled to the sole structure such that the top surface of the sole structure is able to tilt with respect to the lower surface of the sole structure.

BRIEF DESCRIPTION OF THE FIGURES

The accompanying figures, which are incorporated herein, form part of the specification and illustrate embodiments of the present disclosure. Together with the description, the figures further serve to explain the principles of and to enable a person skilled in the relevant art(s) to make and use the disclosed embodiments. These figures are intended to be illustrative, not limiting. Although the disclosure is generally described in the context of these embodiments, it should be understood that it is not intended to limit the scope of the disclosure to these particular embodiments. In the drawings, like reference numbers indicate identical or functionally similar elements.

In the following, embodiments of the disclosure will be described in more detail with reference to the following figures.

DETAILED DESCRIPTION

Figure 1:
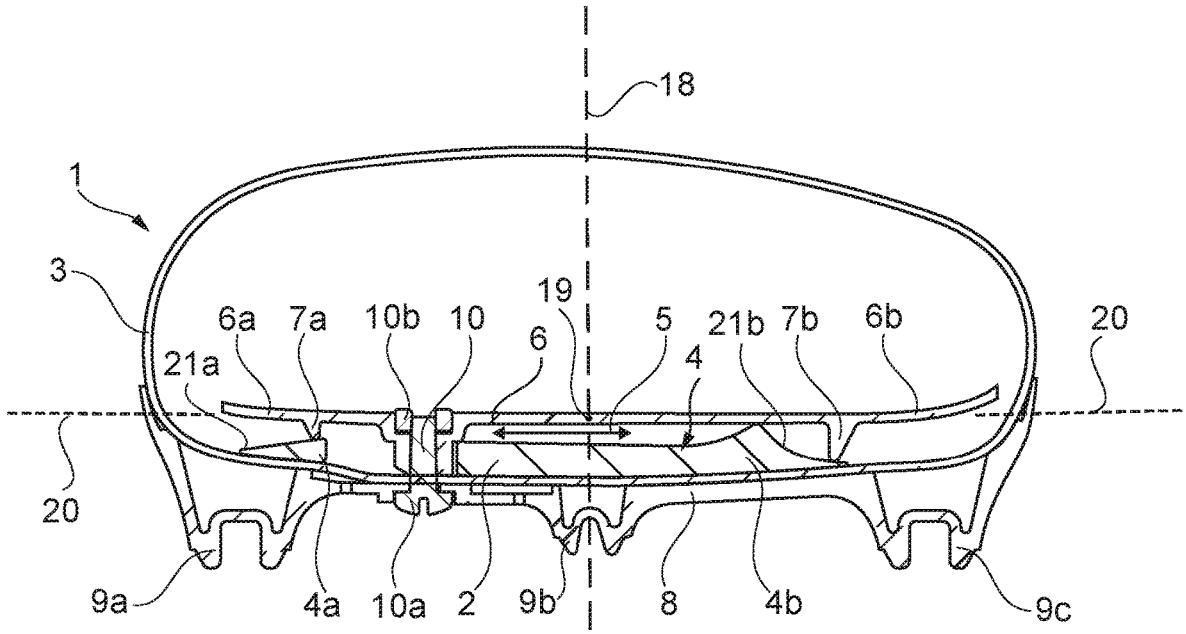
FIG. 1 illustrates a shoe according to some embodiments.

The indefinite articles "a," "an," and "the" include plural referents unless clearly contradicted or the context clearly dictates otherwise.

The term "comprising" is an open-ended transitional phrase. A list of elements following the transitional phrase "comprising" is a non-exclusive list, such that elements in addition to those specifically recited in the list may also be present. The phrase "consisting essentially of" limits the composition of a component to the specified materials and those that do not materially affect the basic and novel characteristic(s) of the component. The phrase "consisting of" limits the composition of a component to the specified materials and excludes any material not specified.

As used herein, the term "essentially parallel" refers to two surfaces that are within ten degrees of being parallel.

As used herein, the term "essentially flat" refers to a surface that within ten degrees of horizontal.

As used herein, the term "essentially cover" refers to instances in which a first surface covers greater than or equal to eighty percent of a second surface.

As used herein, the term "essentially orthogonal" refers to two surfaces that are within ten degrees of being orthogonal.

Where a range of numerical values comprising upper and lower values is recited herein, unless otherwise stated in specific circumstances, the range is intended to include the endpoints thereof, and all integers and fractions within the range. It is not intended that the disclosure or claims be limited to the specific values recited when defining a range. Further, when an amount, concentration, or other value or parameter is given as a range, one or more ranges, or as list of upper values and lower values, this is to be understood as specifically disclosing all ranges formed from any pair of any upper range limit or value and any lower range limit or value, regardless of whether such pairs are separately disclosed.

In the following only some possible embodiments of the disclosure are described in detail. However, the present disclosure is not limited to these, and a multitude of other embodiments are applicable without departing from the scope of the disclosure. The presented embodiments may be modified in a number of ways and combined with each other whenever compatible and certain features may be omitted in so far as they appear dispensable. In particular, the disclosed embodiments may be modified by combining certain features of one embodiment with one or more features of another embodiment.

It is to be understood that not all features of the described embodiments have to be present for realizing the technical advantages provided by the present disclosure, which is defined by the subject-matter of the claims. The disclosed embodiments may be modified by combining certain features of one embodiment with one or more features of another embodiment. Specifically, the skilled person will understand that features, and/or functional elements of one embodiment may be combined with technically compatible features, and/or functional elements of any other embodiment of the present disclosure given that the resulting combination falls within the definition of the present disclosure.

Throughout the present figures and specification, the same reference numerals refer to the same elements. For the sake of clarity and conciseness, certain embodiments of components or steps of certain embodiments are presented without undue detail where such detail would be apparent to those skilled in the art in light of the teachings herein and/or where such detail would obfuscate an understanding of the embodiments.

As understood by the skilled person and/or in order to avoid redundancies, reference is also made to the explanations in the preceding sections, which also apply to the following detailed description. Further, not all features, parts, elements, aspects, components and/or steps are expressly indicated by reference signs for the sake of brevity and clarity. This particularly applies, where the skilled person recognizes that such features, parts, elements, aspects, components and/or steps are present in a plurality.

In the figures which are to be described in the following, the medial side of the shoe, sole structure or elements/components is assumed to be on the left side of the respective figure, whereas the lateral side is assumed to be on the right side of the respective figure. The terms "lateral" and "medial" are defined based on the anatomy of the human foot. The medial side of the foot faces the midline of the body while the lateral side faces away from the midline of the body.

The present invention addresses the problems described above by the subject matter of the disclosure.

In some embodiments, a sole structure according to the disclosure may comprise a slider element configured to slide in a transverse direction of the sole structure, wherein the slider element is configured to slide towards a medial side of the sole structure when pressure is applied to a lateral portion of the sole structure, and wherein the slider element is configured to slide towards a lateral side of the sole structure when pressure is applied to a medial portion of the sole structure.

In some embodiments, the slider element according to the disclosure may create a banking effect by sliding to a particular side of the sole structure. For example, when applying pressure to the lateral portion of the sole structure, the slider element may slide to the medial side and may push up the medial side of the sole structure, while the lateral side is pushed down by the pressure exerted. This movement creates a banking effect which is particularly pronounced because, compared to conventional solutions, one side of the sole structure is lowered and the opposing side is raised. Moreover, because pressure may be applied to both the lateral and the medial portion of the sole structure during linear movements, the slider element would not slide and no undesired banking would occur.

In some embodiments, the sole structure may be configured such that a thickness of the medial portion of the sole structure may increase when the slider element slides towards the medial side of the sole structure. In some embodiments, the sole structure may be configured such that a thickness of the lateral portion of the sole structure may increase when the slider element slides towards the lateral side of the sole structure. In this way, an angle formed between an upper side of the sole structure and a lower side of the sole structure may be changed by the movement of the slider element. If, before the movement of the slider element, a top surface and a bottom surface of the sole structure were essentially parallel, then after a movement of the slider element both surfaces may be tilted relative to each other. By a movement in the opposite direction, both surfaces may again be brought into an essentially parallel orientation.

In some embodiments, the sliding of the slider element may cause a top surface of the sole structure to tilt with respect to a lower surface of the sole element. In this way, a pronounced banking effect may be created due to the movement of the slider element.

In some embodiments, the sole structure may further comprise a foot support element configured to interact with the slider element, such that the slider element slides towards the medial side of the sole structure when pressure is applied to a lateral portion of the foot support element and such that the slider element slides towards the lateral side of the sole structure when pressure is applied to a medial portion of the foot support element. In some embodiments, the foot support element faces and supports the sole of a foot of a wearer of the shoe. The foot support element may essentially cover the entire sole of the foot. Alternatively, the foot support element may cover a portion of the sole. The interaction between the wearer and the sole structure is essentially via the foot support element. The foot support element may define the top surface mentioned above.

In some embodiments, the sole structure may comprise at least one gliding surface which may be tilted relative to a horizontal plane defined by the sole structure and at least one pressure element which may be configured to interact with the gliding surface such that the slider element may be caused to slide when pressure is applied to the sole structure. By the tilt of the gliding surface the pressure exerted onto the pressure element is split into a vertical and horizontal component. The vertical component may be orthogonal to the horizontal plane defined by the sole structure whereas the horizontal component may be parallel to the horizontal plane defined by the sole structure. The horizontal force component may cause a movement of the slider element. In this way, the slider element may be caused to slide simply by providing a tilted gliding surface interacting with a pressure element.

In some embodiments, the pressure element may be realized by a gliding surface. Thus, the horizontal movement described above may be realized by two contacting gliding surfaces, wherein at least one of the surfaces is tilted relative to a horizontal plane defined by the sole structure.

In some embodiments, at least one end of the slider element may comprise a gliding surface or a pressure element. Thus, a movement of the slider element may be caused by pressure exerted onto the end of the slider element comprising a gliding surface or a pressure element.

In some embodiments, the sole structure may comprise a ground facing element, wherein the slider element may be sandwiched between the ground facing element and the foot support element. In some embodiments, the ground facing element may be arranged opposite the foot support element and define the interaction of the sole structure with the ground, potentially via one or more further elements such as an outsole. The ground facing element may define the lower surface of the sole structure mentioned above.

In some embodiments, at least some portions of the lateral and/or medial edges of the ground facing element and the foot support element may be unconnected and movable relative to each other. In this way, the foot support element may be freely tilted with respect to the ground facing element to achieve the desired banking effect.

In some embodiments, the ground facing element and/or the foot support element may comprise a gliding surface. This gliding surface may interact with a pressure element or corresponding gliding surface on the slider element to cause the slider element to move when a force or pressure is applied via the gliding surface.

In some embodiments, the slider element may be arranged in a forefoot portion of the sole structure, for example, corresponding to metatarsal fat pads. The location of the slider element in the front part of the sole structure may enhance the effect of banking as the forefoot portion of a foot is broader than the mid part and the rear part and thus exerts the largest force on the slider element when it comes to lateral movements. Furthermore, during lateral movements, more pressure is usually exerted on the forefoot than on the rearfoot such that the banking effect may be more pronounced. This may increase the performance of lateral movements that involve plantar flexion (for example, extension at the ankle).

In some embodiments, the ground facing element may comprise at least one cleat. Cleats may improve the traction of the shoe, such as on corresponding ground surfaces. For example, the cleats of soccer shoes may improve the traction of the shoes on grass turf. A cleat may improve traction in all directions, such as with respect to lateral movements where the banking effect becomes important.

In some embodiments, the slider element may be arranged in an overlapping manner with the at least one cleat. In the overlapping arrangement, the slider element and the cleat may interact, such as during lateral movements. The cleat may improve traction of shoe and may avoid a slipping of the shoe, whereas the slider element may cause a banking effect to improve the foot shank alignment and keeps the ankle joint out of dangerous positions.

In some embodiments, the sole structure may comprise an upper gliding element and/or a lower gliding element, wherein the upper gliding element and the lower gliding element are configured to interact with the slider element. The foot support element may be connected to or comprise the upper gliding element and/or the ground facing element may be connected to or comprise the lower gliding element. The upper gliding element and the lower gliding element may interact with the slider element and may cause a sliding of the slider element when pressure is applied to the upper and/or lower gliding element. The upper gliding element, lower gliding element, and the slider element may form a unit or component which can be integrated into a shoe to achieve a banking effect as described herein. In some embodiments, the upper gliding element and/or the lower gliding element may be integral with the sole structure.

In some embodiments, the upper gliding element and/or the lower gliding element may comprise at least one gliding surface which may be tilted relative to a horizontal plane defined by the sole structure and may be configured to interact with a gliding surface or a pressure element of the slider element such that the slider element may be caused to slide when pressure is applied to the sole structure. Thus, the tilted gliding surface may create a horizontal force component which may cause the slider element to slide or move and thus to create a banking effect as described herein.

In some embodiments, the upper gliding element and/or the lower gliding element may comprise at least one pressure element which may be configured to interact with a gliding surface of the slider element such that the slider element may slide when pressure is applied to the sole structure. In some embodiments, the gliding surface may be arranged at the slider element. The gliding surface may be tilted relative to a horizontal plane defined by the sole structure. When pressure is applied on the lateral or medial portion of the sole structure, a horizontal force component may be created, which causes the slider element to slide or move and thus to create a banking effect as described herein.

In some embodiments, the sole structure may further comprise a pivot point, wherein the upper gliding element is connected to the lower gliding element at the pivot point. The pivot point may allow a rotation of the upper gliding element relative to the lower gliding element to cause a banking effect. Moreover, the pivot point adds to the stability of the sole structure.

In some embodiments, the pivot point may be realized by a screw and a nut. This arrangement may allow for a quick assembly of the sole structure and a secure connection of the upper gliding element and the lower gliding element. The upper gliding element may rest rotatably on the lower gliding element, such that tilting may be possible at least to some extent without deformation of the upper and/or lower gliding element. This may be realized by the nut and screw, wherein there may be a gap between the upper and/or lower gliding element and the nut and/or screw. In addition, the tilting may be possible at least to some extent by deformation of the upper and/or lower gliding element, which may be elastic. Generally, the pivot point may be realized by other means for connecting the upper gliding element to the lower gliding element, such that a translational movement of the upper and lower gliding element along a horizontal plane may be prevented, while at the same time allowing at least some rotational movement.

In some embodiments, the pivot point may be located more proximal to a medial side of the sole structure than to a lateral side. This arrangement may increase the possible tilt angle and banking effect on the medial side of the sole structure which may be beneficial during cut movements. A typical offset of the pivot point in the context of the present invention may be 5% to 40%, 10% to 30%, or around 20% of the foot width. In relation to the width of the foot support element at the location of the slider element, the pivot point may be offset from a transversal axis of the width of the foot support element towards the medial or lateral side at a distance from 5 to 35% of the width of the foot support element, 10 to 30%, or 15 to 25%.

In some embodiments, the slider element may comprise an aperture and the pivot point may be arranged at least partially in the aperture. Thus, the pivot point may provide further guiding for the slider element and limit the movements of the slider element to some extent.

In some embodiments, the tilting of the top surface of the sole structure with respect to a lower surface of the sole element may define a tilting angle, wherein a maximum tilting angle may be greater than or equal to 5 degrees and less than or equal to 20 degrees, or less than or equal to 10 degrees. In some embodiments, this range of the tilting angle may improve the foot shank alignment and may keep the ankle joint out of dangerous positions during lateral movements.

In some embodiments, the sole structure may be configured such that a tilting in only one of a medial direction and a lateral direction is possible. In some embodiments, the sole structure may be configured such that tilting in only the medial direction is possible. Thus, a targeted banking effect may be created. For example, a banking effect on just the medial side may be beneficial during lateral movements.

In some embodiments, a first end of the slider element may comprise a first gliding surface and a second end of the slider element may comprise a second gliding surface, wherein the first gliding surface may be essentially flat and, wherein the second gliding surface may comprise a concave shape. The concave shape may lead to a high restoring force at a maximum tilting angle when the cut movement is finished, as the maximum gradient of the sliding surface may be located on the inner portion of the gliding surface. Thus, pressure may be exerted on this inner portion first. The gradient of the sliding surface on the outer portion of the gliding surface is comparably smaller such that the restoring force acting on the slider element is smaller. This arrangement may be advantageous because only tilting in one direction may be allowed, but at the same time a high restoring force may be present to bring the foot support element back in a horizontal position after the cut movement is finished.

In some embodiments, the foot support element may be elastic. The elasticity may allow the slider element to elastically deform the foot support element when sliding. For example, the side of the foot support element on which pressure is exerted (the "driven side") may not lower as much as the opposing side (the "reaction side") is lifted by the slider element. This may be achieved by configuring the gliding surface and the pressure element on the driven side such that the foot support element at the reaction side may be lifted higher by the opposing gliding surface of the slider element than it would be lifted by the lever rotating around the pivot point. As the foot support element may be elastically deformable the reaction side bends upwards. Thus, the foot support element may not be a simple seesaw mechanism, but instead may be actively pushed upwards at the reaction side and elastically deformed by the slider element.

In some embodiments, the slider element may comprise nylon, polyoxymethylene (POM), polytetrafluoroethylene (PTFA), polyamide-imide (PAI), polyetherimide (PEI), polyether ether ketone (PEEK) and/or polyamide (PA). The mentioned materials may provide low friction and sufficient strength but are also relatively low weight. Other elements of the sole structure, in particular the gliding surfaces/pressure elements or the components with the gliding surfaces/pressure elements, may comprise the listed materials as well.

In some embodiments, a shoe may comprise a sole structure as described herein and an upper coupled to the sole structure. The technical properties shown or described herein for the sole structure and advantages and the improvements of the sole structure over the state of the art are likewise applicable to the shoe, which may be a sports shoe. Same applies vice versa. In some embodiments, the shoe may be a tennis shoe, a football shoe, a basketball shoe or a training shoe. In some embodiments, the upper may be coupled to either the foot support element or the ground facing element.

In some embodiments, the upper may be coupled to the sole structure such that the top surface of the sole structure is able to tilt with respect to the lower surface of the sole element. In this way, the banking effect described herein can be created without being restrained by the upper.

FIG. 1 illustrates an embodiment of the present disclosure by means of a cross section through a forefoot portion of a shoe 1 comprising a sole structure 2 according to the disclosure and an upper 3. The shoe is shown as a soccer shoe, but the disclosure may be applied to a wide variety of shoes, in particular sports shoes. Examples include basketball shoes, running shoes, tennis shoes, training shoes, etc.

In some embodiments, the sole structure 2 may comprise a slider element comprising a medial portion 4*a* and a lateral portion 4*b*. It is understood that the portions 4*a* and 4*b* may be joined and that they may appear as separate components due to the cross-sectional nature of FIG. 1. Henceforth, the slider element will be denoted with the reference numeral 4.

In some embodiments, the slider element 4 may rest on the upper 3 which may wrap around the foot. The upper 3 may be provided with a low friction surface so that the slider element 2 may easily move in a transverse direction of the sole structure 2. A transverse direction is understood as a lateral-to-medial direction or a direction being essentially orthogonal (for example, within 10 degrees of orthogonal) to a longitudinal axis of the sole structure 2 or the shoe 1. As such, the slider element 4 is configured to slide in a direction indicated by the arrow 5 in FIG. 1.

In some embodiments, the sole structure 2 also may comprise a foot support element 6 on which the foot rests. In some embodiments, the foot support element 6 may be covered by an insole, sockliner or the like, but this does not alter the basic principles of the disclosure. The foot support element 6 may comprise a medial portion 6*a* and a lateral portion 6*b* which are again defined with respect to the foot. Furthermore, the support element 4 may comprise two pressure elements 7*a* and 7*b* which may be formed as downward facing protrusions of the foot support element 6. The medial pressure element 7*a* may be arranged on the medial portion 6*a* of the foot support element 6, whereas the lateral pressure element 7*b* may be arranged on the lateral portion 6*b* of the foot support element 6. The medial pressure element 7*a* may be in contact with the medial portion 4*a* of the slider element 4, whereas the lateral pressure element 7*b* may be in contact with the lateral pressure element 4*b*.

In some embodiments, the medial portion 4*a* and the lateral portion 4*b* of the slider element may both comprise inclined gliding surfaces (such as gliding surfaces 21*a* and 21*b*). The gliding surfaces 21*a* and 21*b* may be inclined or tilted relative to a plane defined by the sole structure 2. In the example of FIG. 1, such a plane may be perpendicular to the plane of projection, and the sliding trajectory of the slider element denoted by the reference numeral 5 would lie in this plane. Exemplary angles of inclination of the gliding surfaces 21*a* and 21*b* shown in the embodiments described herein may include 10°-45°, 10°-30°, or around 20°. As will be described below, the angle of inclination of the gliding surfaces 21*a* and 21*b* need not to be constant but may vary across the gliding surfaces 21*a* and 21*b*.

In some embodiments, pressure exerted onto the medial portion 6*a* of the foot support element 6 by the foot, for example during a cut movement, may be passed to the gliding surface of the medial portion 4*a* of the slider element 4 by means of the pressure element 7*a*. Due to the inclination of the gliding surface 21*a* of the medial portion 4*a* of the slider element 4, the slider element 4 may be caused to slide towards the lateral side of the sole structure or shoe. Consequently, the inclined gliding surface 21*b* of the lateral portion 4*b* of the slider element pushes the lateral side 6*b* of the foot support element 6 upwards by means of the pressure element. At the same time, the medial portion 6*a* of the foot support element 6 may be lowered as the pressure element 7*a* slides down the inclined gliding surface 21*a* of the medial portion of the slider element 4. In this way, the entire foot support element may be tilted to the medial side of the sole structure 2 or shoe 1 such that a pronounced banking effect is generated. Typical tilting angles achieved in the embodiments of the present disclosure range from greater than or equal to 1 degree to less than or equal to 20 degrees.

In some embodiments, if pressure is applied to the lateral side of the sole structure 2, for example because the wearer has finished a cut movement and shifts weight from the medial to the lateral side, the lateral pressure element 7*b* may interact with the inclined gliding surface 21*b* of the lateral portion 4*b* of the glider element 4. The pressure or force exerted onto this inclined surface may cause the glider element 4 to move towards the medial side of the sole structure 2 or shoe 1. The lateral pressure element 7*b* may slide down the inclined gliding surface 21*b* of the lateral portion 4*b* of the glider element 4. At the same time, the inclined gliding surface 21*a* of the medial portion 4*a* of the glider element 4 may push the lateral pressure element 7*a* up. As a result, the foot support element 6 may tilt back towards the lateral side and into the neutral, horizontal position.

In some embodiments, the inclination angle at the medial portion 4*a* of the slider element may be as low as possible so that the foot support element 6 does not abruptly start tilting but that instead there may be a smooth transition from the neutral position to the banking position. Conversely, the inclination angle may be high enough so that a force or pressure transfer onto the slider element 4 activates the banking effect.

In some embodiments, the inclined gliding surface 21*b* of the lateral portion 4*b* of the glider element 4 may be concave. Therefore, when the glider element 4 starts sliding back towards the medial side of the sole structure 2, the lateral pressure element 7*b* may be in contact with the steeper portion of the gliding surface 21*b* (for example, the portion of the gliding surface 21*b* that is closer to the foot support element 6) such that the restoring force is large as compared with the shallower portion (for example, the portion of the gliding surface 21*b* that is further from the foot support element 6). In contrast, when the glider element 4 has almost reached the medial side, the lateral pressure element 7*b* may be in contact with the shallower portion of the gliding surface 21*b* and the restoring force may be comparably small as compared to the steeper portion. Accordingly, the slider element 4 cannot be pushed further in the medial direction. Therefore, a banking effect to the lateral side may be limited or prevented in the embodiment of FIG. 1.

Assuming that FIG. 1 shows a right shoe of a pair of shoes, the left shoe would typically also allow a banking effect in just a medial direction (of the left foot). In some embodiments, the banking effect may be symmetrical. In some embodiments, an asymmetrical banking effect with respect to a pair of shoes may be achieved by allowing a banking effect to the medial side in one shoe (for example, the right shoe) and to the lateral side in the other shoe (for example, the left shoe). With reference to a particular foot, the banking would be opposite (medial versus lateral) but from an absolute point of view the banking would be in the same direction (the left or right side of the wearer). Such an embodiment may be advantageous, for example, for running on a track where the direction of lateral acceleration is always the same.

In some embodiments, the sole structure 2 may comprise a ground facing element 8 which may be arranged beneath the portion of the upper 3 wrapping under the foot. In some embodiments, the ground facing element 8 may be configured to contact the ground. In some embodiments, the ground facing element 8 may not directly contact the ground. For example, an outsole may be arranged beneath the ground facing element 8 which may be configured to contact the ground. In some embodiments, the ground facing element 8 may comprise a plurality of cleats, three of which are shown in the cross-section and denoted by reference numerals 9*a*, 9*b* and 9*c*, respectively. The cleat 9*b* arranged in the middle may fully overlap with the slider element 4, whereas the outer cleats 9*a* and 9*c* may partly overlap with the slider element 4 depending on the position of the slider element 4, for example, whether it is in the neutral position on the medial side of the sole structure 2 or shoe 1 or the banking position on the lateral side of the sole structure 2 or shoe 1 as described above.

The sole structure 2 may comprise a pivot point 10 around which the foot support element 6 may rotate when moving from the neutral position to the banking position and vice-versa. In some embodiments, the pivot point 10 may be a screw 10*a*. The head of the screw 10*a* may abut the bottom surface of the ground facing element 8. The shaft of the screw 10*a* may project through the ground facing element 8, the portion of the upper 3 wrapping under the foot and the foot support element 6. It may be held in place by a matching nut 10*b* which is partly arranged in the foot support element 6. Thus, the screw 10*a* and the nut 10*b* may secure the sole structure 2. As there may be a small gap between the foot support element 8 and the screw 10*a* as well as the nut 10*b*, the foot support element 8 may still rotate and tilt relative to the ground facing element 8. In addition, the foot support element 8 may be flexible to some extent.

The pivot point 10 may be offset to the medial side of the sole structure such that the pivot point 10 may not lie on a longitudinal axis of the sole structure 2 and/or shoe 1. This may allow for an increase in the maximum tilt or banking angle. Typical offsets in the context of the present disclosure may be 5% to 40%, 10% to 30%, or around 20% of the foot width. In relation to the width of the foot support element 6 at the location of the slider element 4, the pivot point 10 may be offset from a center 19 of a transversal axis 20 (which may extend in the medial-lateral direction of the foot support element 6) of the width of the foot support element 6 towards the medial or lateral side at a distance from 5 to 35% of the width of the foot support element, 10 to 30%, or 15 to 25%. The pivot point 10 may also be offset from a vertical axis 18 that extends vertically through the center 19 of the transversal axis 20.

Generally, suitable materials for all the embodiments presented herein include nylon, polyoxymethylene (POM), polytetrafluoroethylene (PTFE), polyamide-imide (PAI), polyetherimide (PEI), polyether ether ketone (PEEK) and/or polyamide (PA), or other materials providing low friction and sufficient strength but also relatively low weight.

Having described the principle underlying the present disclosure, additional embodiments will now be described.

Figure 2:
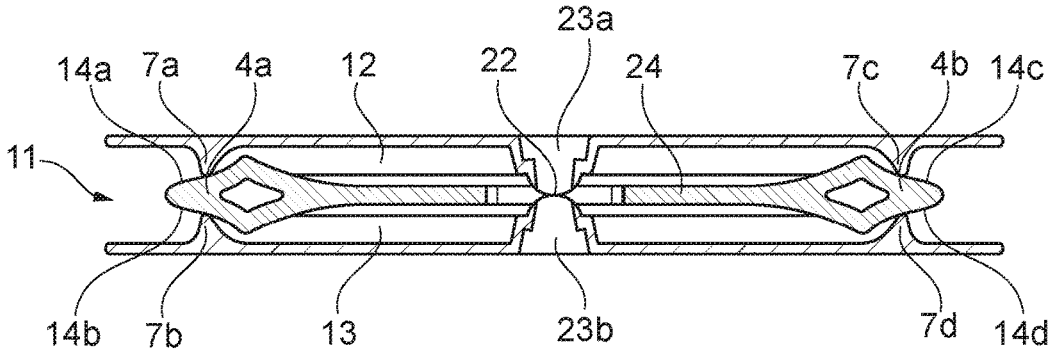
FIG. 2 illustrates a unit or component comprising an upper gliding element, a lower gliding element and a slider element arranged between the upper gliding element and the lower gliding element according to some embodiments.

FIG. 2 illustrates a unit or component 11 comprising an upper gliding element 12 and a lower gliding element 13 and a slider element 24 arranged between the upper gliding element 12 and the lower gliding element 13. The unit or component 11 may be integrated in a sole structure (for example, the sole structure 2 of FIG. 1) according to the disclosure. Alternatively, the upper gliding element 12 and/or the lower gliding element 13 may be integrally formed with the rest of the sole structure. For example, the upper gliding element 12 may be an integral part of a foot support element described previously (for example, the foot support element 6) and the lower gliding element 13 may be an integral part of a ground facing element described previously (for example, the ground facing element 8).

In some embodiments, the slider element 24 may comprise four gliding surfaces, namely an upper gliding surface 14*a* and a lower gliding surface 14*b* on the medial side 4*a* and an upper gliding surface 14*c* and a lower gliding surface 14*d* on the lateral side 4*b*.

In some embodiments, matching the four gliding surfaces of the slider element 24 are four pressure elements 7*a*, 7*b*, 7*c* and 7*d*. The pressure element 7*a* may be arranged on the bottom side of the upper gliding element 12 and may contact the upper medial gliding surface 14*a* of the glider element 4. The pressure element 7*b* may be arranged on the top side of the lower gliding element 13 and may contact the lower medial gliding surface 14*b* of the glider element 4. The pressure element 7*c* may be arranged on the bottom side of the upper gliding element 12 and may contact the upper lateral gliding surface 14*c* of the glider element 4. The pressure element 7*d* may be arranged on the top side of the lower gliding element 13 and may contact the lower lateral gliding surface 14*d* of the glider element 4. In some embodiments, all gliding surfaces 14*a*, 14*b*, 14*c* and 14*d* may be concave. In some embodiments, at least one of the gliding surfaces 14*a*, 14*b*, 14*c*, and 14*d* may be concave. In some embodiments, none of the gliding surfaces 14*a*, 14*b*, 14*c*, and 14*d* may be concave.

In some embodiments, the unit or component 11 may comprise a pivot point 22 around which the upper gliding element 12 and the lower gliding element 13 may rotate relative to each other to create a banking effect in a sole structure as described herein. In some embodiments, the pivot point 22 can comprise two abutting barrel-shaped protrusions 23*a* (for example, an upper pivot element) and 23*b* (for example, a lower pivot element) arranged on the upper gliding element 12 and lower gliding element 13, respectively.

In some embodiments, the slider element 24 may be symmetric. Additionally or alternatively, the upper gliding element 12 and lower gliding element 13 may be symmetric. Hence, in some embodiments, a banking effect may be achieved in both a lateral and a medial direction. More specifically, the slider element 24 when sliding in a lateral direction may cause the upper gliding element 12 to raise its lateral side and to lower its medial side as compared to the lower gliding element 13. Conversely, the slider element 24 sliding in a medial direction may cause the upper gliding element 12 to raise its medial side and to lower its lateral side relative to the lower gliding element 13. In the neutral position, which is shown in FIG. 2, the upper gliding element 12 and the lower gliding element 13 may be parallel to each other such that no banking effect occurs.

In some embodiments, the sliding of the slider element 24 may be caused by pressure or force exerted on the medial or lateral portion of the upper gliding element 12. Thus, pressure or force exerted on the medial portion of the upper gliding element 12 may cause the slider element 24 to slide towards the lateral side and pressure exerted on the lateral side of the upper gliding element 12 may cause the slider element 24 to slide towards the medial side. These movements may achieved by the interaction of the pressure elements 7*a*, 7*b*, 7*c* and 7*d* with the corresponding inclined or tilted gliding surfaces 14*a*, 14*b*, 14*c* and 14*d*.

Figure 3:
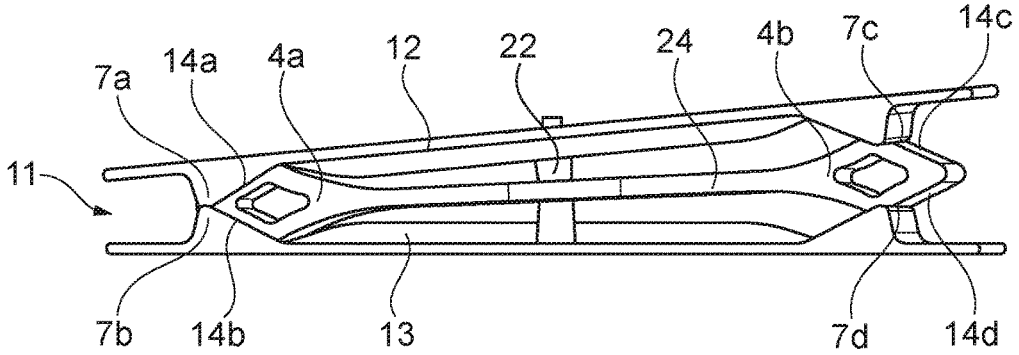
FIG. 3 illustrates a unit or component comprising an upper gliding element, a lower gliding element and a slider element arranged between the upper gliding element and the lower gliding element according to some embodiments.

FIG. 3 illustrates the unit or component 11 comprising the upper gliding element 12 and the lower gliding element 13 and the slider element 24 arranged between the upper gliding element 12 and the lower gliding element 13. The embodiment of FIG. 3 is similar to the embodiment of FIG. 2. For example, the unit or component 11 may be symmetric such that a banking effect in both a medial direction and a lateral direction is achieved. The slider element 24 may comprise the four gliding surfaces 14*a*, 14*b*, 14*c*, 14*d* interacting with the corresponding pressure elements 7*a*, 7*b*, 7*c* and 7*d* on the upper gliding element 12 and the lower gliding element 13, respectively.

In FIG. 3, the unit or component 11 is shown in a tilted position in which the banking effect occurs to the medial side. As described with reference to FIG. 2, the unit or component 11 of FIG. 3 may also tilt to the lateral side due to its symmetric nature.

Figure 4A:
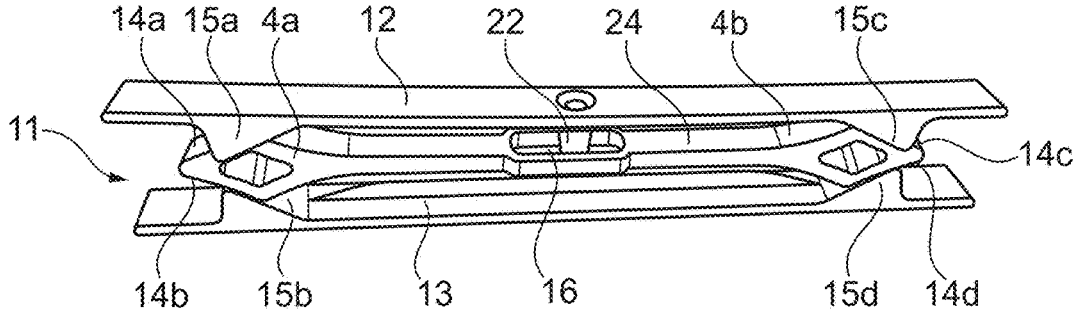
FIGS. 4A and 4B show a unit or component comprising an upper gliding element, a lower gliding element and a slider element arranged between the upper gliding element and the lower gliding element according some embodiments.
Figure 4B:
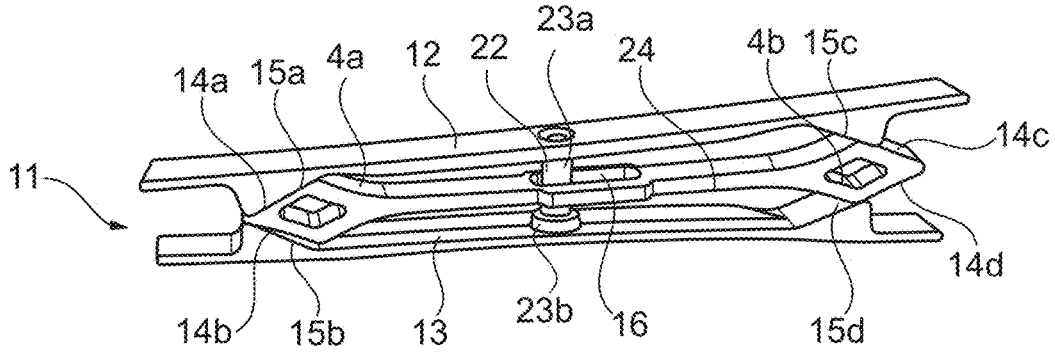

FIGS. 4A and 4B show an embodiment of a unit or component 11 comprising the upper gliding element 12 and the lower gliding element 13 and the slider element 24 arranged between the upper gliding element 12 and the lower gliding element 13. FIG. 4A shows the unit or component 11 in a neutral position, whereas FIG. 4B shows the unit or component 11 in a tilted position. This embodiment is similar to the embodiments of FIGS. 2 and 3, however, instead of the pressure elements 7*a*, 7*b*, 7*c*, and 7*d*, the upper gliding element 12 and lower gliding element 13 may comprise gliding surfaces 15*a*, 15*b*, 15*c* and 15*d* to interact with the corresponding gliding surfaces 14*a*, 14*b*, 14*c* and 14*d*, respectively, of the slider element 24. As such, the gilding surfaces 15*a*, 15*b*, 15*c* and 15*d* may have a similar angle of inclination as the gliding surfaces 14*a*, 14*b*, 14*c* and 14*d*.

In some embodiments, the unit or component 11 may comprise a pivot 22 which is realized as the upper pivot element 23*a* connected to the lower pivot element 23*b*, thereby connecting the upper gliding element 12 and lower gliding element 13. In some embodiments, the slider element 24 may comprise an aperture 16 in which the pivot 22 is movably arranged. Thus, the upper/lower pivot elements 23*a*, 23*b* and the aperture 16 may limit the movements of the slider element 24 and form a guiding means for the support element 24. As an alternative to the upper and lower pivot elements 23*a*, 23*b*, a screw and a nut may be used as presented in other embodiments described herein (for example, as described with reference to FIG. 5). Still another alternative would be to form the upper and lower gliding elements including its pivot point integrally.

Figure 5:
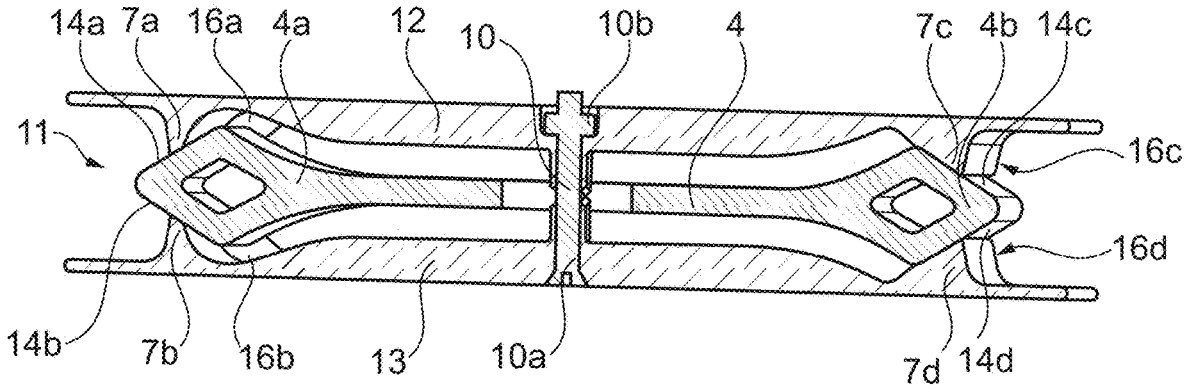
FIG. 5 illustrates a unit or component comprising an upper gliding element, a lower gliding element and a slider element arranged between the upper gliding element and the lower gliding element according to some embodiments.

FIG. 5 illustrates another embodiment of the unit or component 11 comprising the upper gliding element 12 and the lower gliding element 13 and the slider element 24 arranged between the upper gliding element 12 and the lower gliding element 13. The embodiment is similar to the previous embodiments such that the description of the previous figures is applicable to FIG. 5 as well, aside from the differences noted below.

In some embodiments, the unit or component 11 may comprise guiding portions 16*a*, 16*b*, 16*c* and 16*d*. In some embodiments, the guiding portions 16*a*, 16*b*, 16*c* and 16*d* may be walls that block the upper guiding element 12, the lower guiding element 13 and the slider element 4 from rotating relative to each other. As shown in FIG. 5, guiding portion 16*a* may be located on an anterior (for example, closer to a toe portion of the sole structure 2) medial side of the upper guiding element 12, guiding portion 16*b* may be located on the anterior medial side of the lower guiding element 13, guiding portion 16*c* may be located on the anterior lateral side of the upper guiding element 12, and guiding portion 16*d* may be located on the anterior medial side of the lower guiding element 13. In some embodiments, similar guiding portions may be located on the posterior sides of the upper guiding element 12 and lower guiding element 13. Similar to the embodiment of FIG. 1, the pivot point 10 of the embodiment of FIG. 5 may be implemented by a screw 10*a* and nut 10*b*.

Figure 6:
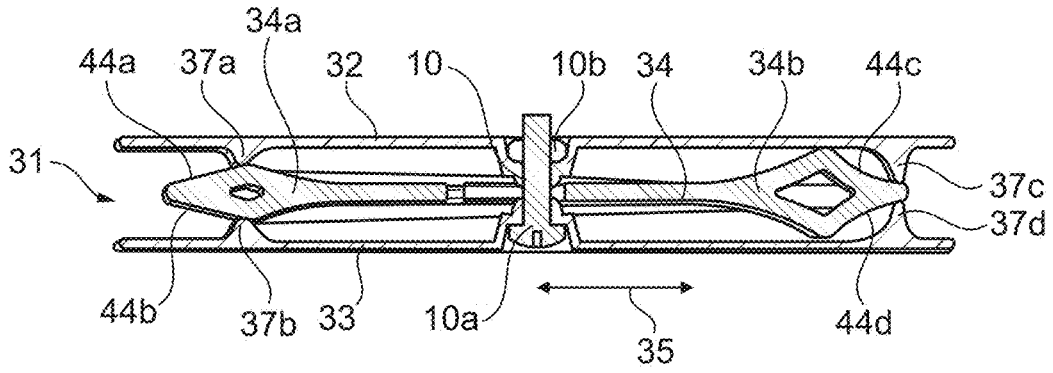
FIG. 6 illustrates a unit or component comprising an upper gliding element, a lower gliding element and a slider element arranged between the upper gliding element and the lower gliding element according to some embodiments.

FIG. 6 illustrates a unit or component 31 comprising an upper gliding element 32 and a lower gliding element 33 and a slider element 34 arranged between the upper gliding element 32 and the lower gliding element 33. The embodiment of FIG. 6 is similar to the previous embodiments such that the description of the previous figures is applicable to FIG. 6 as well. In some embodiments, the embodiment of FIG. 6 may not be symmetric. In some embodiments, a medial portion 34*a* of a slider element 34 has a lower height than a lateral portion 34*b* of the slider element 34. Also, medial pressure elements 37*a* and 37*b* may be smaller than medial pressure elements 37*c* and 37*d* (for example, the medial pressure elements 37*a* and 37*b* may extend away from the upper gliding element 32 and the lower gliding element 33 less than the lateral pressure element 37*c* and 37*d* extend away from the upper gliding element 32 and the lower gliding element 33). In some embodiments, upper and lower gliding surfaces 44*c* and 44*d*, respectively, of the lateral portion 34*b* of the slider element 34 may be concave, whereas upper and lower gliding surfaces 44*a* and 44*b* of the medial portion 34*a* of the slider element 34 may be essentially flat similar to the embodiment of FIG. 1).

In some embodiments, when the slider element 34 is in a neutral position, the lateral pressure elements 37*c* and 37*d* may rest on the flat sections of the gliding surfaces 44*c* and 44*d* (for example, the sections of the gliding surfaces 44*c* and 44*d* that are furthest from the upper gliding element 32 and the lower gliding element 33. These sections may not be inclined relative to plane define by the sole structure 3 or the sliding path 35 of the slider element 34. Therefore, when pressure or a force is exerted on the lateral portion of the upper gliding element 32, there may be no horizontal force component pushing the slider element 34 towards the medial side. In contrast, when pressure or a force is exerted on the medial side of the upper gliding element 32, the pressure elements 37*a* and 37*b* are in contact with the inclined gliding surfaces 44 and 44*b* of the medial portion 34*a* of the slider element 34. Therefore, there may be a horizontal force component pushing the slider element 34 towards the lateral side and lifting the upper gliding element 32 on its lateral side. Hence, in some embodiments, banking may only occur toward the medial side but not the lateral side.

In some embodiments, once the slider element 34 has moved to the lateral side of the unit or component 31, the pressure elements 37*c* and 37*d* may contact the sections of the lateral gliding surfaces 44*c* and 44*d* of the slider element 34 having the largest inclination angle (for example, the portions of the gliding surfaces 44*c* and 44*d* located closest to the upper gliding element 32 and the lower gliding element 33). Hence, in some embodiments, a force or pressure exerted onto the lateral portion of the upper gliding element 32 may cause a horizontal force component which may push the slider element 34 towards the medial side and restore the slider element 34 to the neutral position. Due to the large inclination angle of the gliding surfaces 44*c* and 44*d* in the tilted position of the upper gliding element 32, the initial restoring force will be quite large.

In some embodiments, the foot support element 6 may be elastic. The elasticity may allow the slider element (for example, any of the sliding elements disclosed herein, such as the slider element 4, the slider element 24, the slider element 34, etc.) to elastically deform the foot support element 6 when sliding. The side of the foot support element 6 on which pressure may be exerted (the "driven side") may not lower as much as the opposing side (the "reaction side") is lifted by the slider element 4, 24, 34. In embodiment shown in FIG. 6, this is achieved by configuring the gliding surfaces 44*a* and 44*b* with a smaller angle compared to the opposing gliding surfaces 44*c* and 44*d*, as described above. In some embodiments, when pressure is exerted on the medial side (the driven side) of the upper gliding element 32, the slider element 34 moves towards the lateral side (the reaction side). Because the opposing gliding surfaces 44*c* and 44*d* have a steeper angle than the medial gliding surfaces 44*a* and 44*b*, the lateral side of the upper gliding element 32 may be actively lifted and may bend upwards due to the elasticity of the foot support element 6. Thus, the lateral side of the upper gliding element 32 may be lifted more than would be geometrically possible by a simple seesaw mechanism.

Figure 7A:
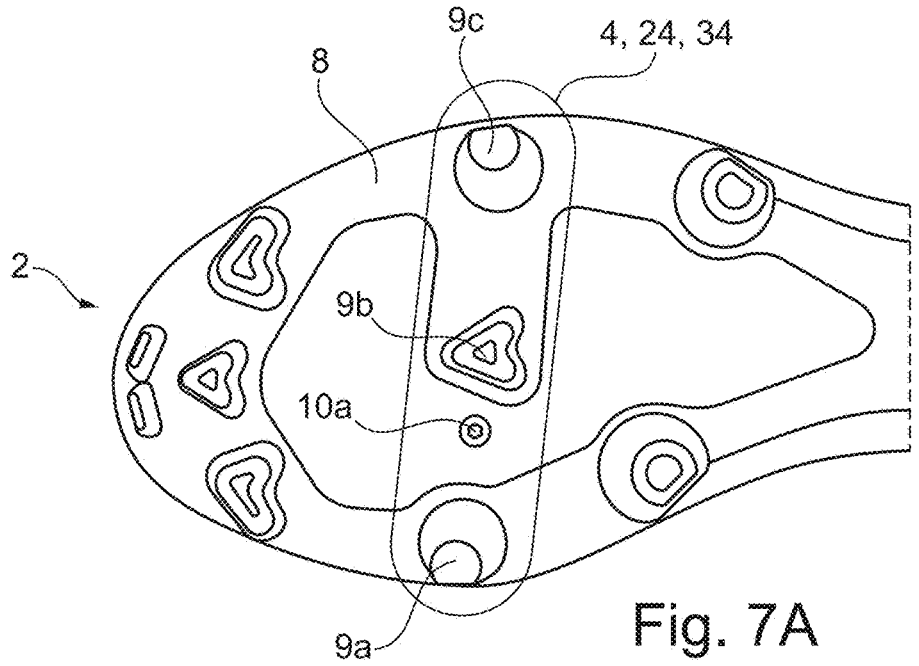
FIGS. 7A and 7B show a sole structure according to some embodiments.
Figure 7B:
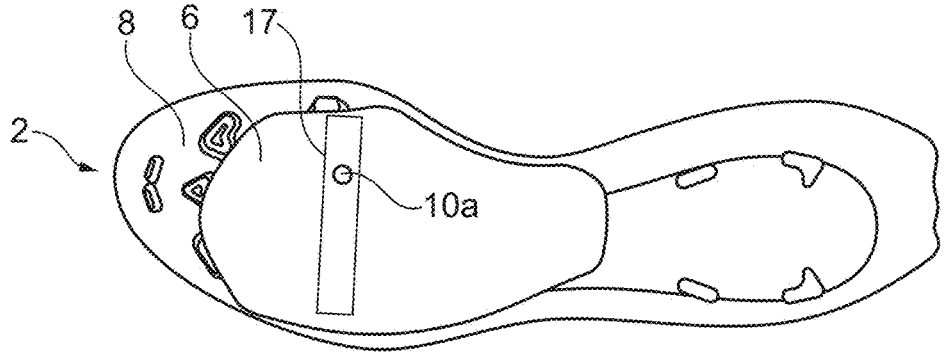

FIGS. 7A and 7B show an embodiment of the sole structure 2 according to the present disclosure in a bottom view (FIG. 7A) and a top view (FIG. 7B). The sole structure 2 may comprise an upper gliding element, a lower gliding element, and a slider element arranged between the upper gliding element and the lower gliding element similar to the embodiments shown in FIGS. 2, 3, 4A, 4B, 5 and 6. In some embodiments, the sole structure 2 may comprise the upper gliding element 12 or the upper gliding element 32. In some embodiments, the sole structure 2 may comprise the lower gliding element 13 or the lower gliding element 33. In some embodiments, the sole structure 2 may comprise the slider element 4, the slider element, 24, or the slider element 34. In some embodiments of FIGS. 7A and 7B, the upper gliding element may be integral with the foot support element 6 and the lower gliding element 13 may be integral with the foot support element 8. In some embodiments, the upper gliding element 6, lower gliding element 8 and the slider element could form a unit or component as previously described (for example, the unit or component 11 or the unit or component 31), which could be sandwiched between the foot support element 6 and the ground facing element 8.

In some embodiments, the bottom side of the sole structure 2 may comprise the ground facing element 8, which may comprise a number of cleats, three of which are denoted by reference numerals 9*a*, 9*b* and 9*c*. The slider element 4, 24, 34 may be arranged above the three cleats 9*a*, 9*b* and 9*c* and may extend from the medial cleat 9*a* via the middle cleat 9*b* to the lateral cleat 9*c* (see FIG. 7A).

In some embodiments, the upper side of the sole structure 2 may comprise the foot support element 6 (see FIG. 7B).

The foot support element 6 in this example may cover a portion of the sole structure 2 and may extend from the metatarsal bones to the middle of the arch. In some embodiments, the foot support element 6 may cover the entire length of the foot or a different portion. Additionally or alternatively, the foot support element 6 may not cover the entire width of the sole structure 2. As shown in FIG. 7B, the ground facing element 8 may extend beyond the foot support element 6. Thus, the foot support element 6 may be received in the ground facing element 8 and may be free to tilt to achieve a banking effect as described herein.

In some embodiments, a location of the slider element 4, 24, 34 arranged between the upper gliding element 12, 32 and the lower gliding element 13, 33 is marked by the rectangle 17. In some embodiments, foot support element 6 and the ground facing element 8 are secured by the screw 10*a* (see FIG. 7A) which may extend through the slider element 4, 24, 34 and into the corresponding nut 10*b* (see FIG. 7B).

Generally, in embodiments disclosed herein, the width of the slider element 4, 24, 34 should be as large as possible to sufficiently support the foot, without having too much overhanging portions of the foot support element 6 in the lateral and medial direction. On the other hand, the width of the slider element 4, 24, 34 must be small enough, so that the slider may still move. Therefore, a width of the slider element may be a minimum of 60% of the maximum width of the upper 3 at the metatarsal joints and a maximum of 90% of the upper 3 at the metatarsal joints.

Generally, in embodiments disclosed herein, the height of the sole structure 2 including the slider element 4, 24, 34 should be as small as possible to avoid a high sole. In some embodiments, the foot support element 6 may extend across the entire length of a sole of a foot. In some embodiments, just a portion of the sole of the foot may be covered by the foot support element 6. In some embodiments, the sole structure may comprise multiple slider elements 4, 24, 34 and corresponding gliding surfaces as described herein. The slider elements 4, 24, 34 may be arranged along the length of the sole structure, for example between a foot support plate and a cleated plate. In some embodiments, the sole structure 2 may comprise a first slider element (for example, a first slider element 4, 24, 34) in a metatarsal region and a second slider element (for example, a second slider element 4, 24, 34) in a heel region. In some embodiments, the sole structure 2 may comprise a first slider element (for example, a first slider element 4, 24, 34) and at least one further slider element (for example, a second slider element 4, 24, 34) in a forefoot region, to sufficiently support a foot support element extending in the forefoot region. In some embodiments, the sole structure 2 may comprise at least one slider element 4, 24, 34 in the midfoot region.

In some embodiments, the length, for example, the dimension of a single slider element 4, 24, 34 in a longitudinal direction, may be limited to maintain the sliding function. The length of a single slider element 4, 24, 34 may be a maximum of 15% of the entire length of the shoe 1. The slider element 4, 24, 34 may generally be arranged in a rotated position relative to the transversal axis 20 (shown, for example, in FIG. 1) of the sole structure 2 of the shoe 1. Thus, banking may be enabled not just in a purely transversal direction but in an intermediate direction between a purely longitudinal and a purely transversal direction. In some embodiments, the slider element 4, 24, 34 may be rotated up to 90 degrees to the transversal axis 20 of the sole structure 2 or shoe 1 so that the slider element 4, 24, 34 lies substantially along a longitudinal axis of the shoe. Such a position of the slider element 4, 24, 34 would enable banking in a longitudinal direction.

In some embodiments, the slider element 4, 24, 34 may be restored to its neutral position by a force or pressure acting on either the medial or lateral portion of the sole structure 2. In such embodiments, the restoring force may be generated by at least one inclined surface which splits the force or pressure acting on the sole structure into a vertical and horizontal component. In some embodiments, the horizontal force component may push the slider element 4 back to its original position. In some embodiments, the restoring force may be provided by a spring element which either pushes or pulls the slider element 4, 24, 34 back to its neutral position. In such embodiments, a single inclined gliding surface may be sufficient to create a banking effect.

For example, the sole structure 2 may comprise a slider element configured to slide in a transverse direction of the sole structure, wherein the slider element is configured to slide towards a first side of the sole structure when pressure is applied to an edge portion of the sole structure, and a spring element configured to push or pull the slider element to a second side of the sole structure opposite the first side. This embodiment may comprise one or more of the features of the embodiments described previously. In other words, it may be combined with the previous embodiments or subcombinations of features of the previous embodiments. Thus, it may not be necessary to apply a pressure or force to the opposing side of the sole structure to restore the slider element to its original position. Rather, this may be accomplished by the spring element.

While various embodiments have been described herein, they have been presented by way of example, and not limitation. It should be apparent that adaptations and modifications are intended to be within the meaning and range of equivalents of the disclosed embodiments, based on the teaching and guidance presented herein. It therefore will be apparent to one skilled in the art that various changes in form and detail may be made to the embodiments disclosed herein without departing from the spirit and scope of the present disclosure. The elements of the embodiments presented herein are not necessarily mutually exclusive, but may be interchanged to meet various situations as would be appreciated by one of skill in the art.

The examples are illustrative, but not limiting, of the present disclosure. Other suitable modifications and adaptations of the variety of conditions and parameters normally encountered in the field, and which would be apparent to those skilled in the art, are within the spirit and scope of the disclosure.

It is to be understood that the phraseology or terminology used herein is for the purpose of description and not of limitation. The breadth and scope of the present disclosure should not be limited by any of the above-described exemplary embodiments, but should be defined in accordance with the following claims and their equivalents.

What is claimed is:

1. A sole structure for a shoe, wherein the sole structure comprises:

an upper gliding element;

a lower gliding element connected to the upper gliding element at a pivot point; and a slider element arranged between the upper gliding element and the lower gliding element and configured to slide relative to the upper gliding element and the lower gliding element in a transverse direction of the sole structure, wherein the slider element is configured to slide towards a medial side of the sole structure when pressure is applied to a lateral portion of the sole structure, and wherein the slider element is configured to slide towards a lateral side of the sole structure when pressure is applied to a medial portion of the sole structure.

2. The sole structure of claim 1, wherein the sole structure is configured such that a thickness of the medial portion of the sole structure increases when the slider element slides towards the medial side of the sole structure, and wherein the sole structure is configured such that a thickness of the lateral portion of the sole structure increases when the slider element slides towards the lateral side of the sole structure.

3. The sole structure of claim 1, wherein the sliding of the slider element causes a top surface of the sole structure to tilt with respect to a lower surface of the sole structure.

4. The sole structure of claim 3, wherein the tilting of the top surface of the sole structure with respect to the lower surface of the sole structure defines a tilting angle, wherein a maximum tilting angle is greater than or equal to 5 degrees and less than or equal to 10 degrees.

5. The sole structure of claim 3, wherein the sole structure is configured such that a tilting in only one of a medial direction or a lateral direction is possible.

6. The sole structure of claim 1 further comprising a foot support element configured to interact with the slider element, such that the slider element slides towards the medial side of the sole structure when pressure is applied to a lateral portion of the foot support element and such that the slider element slides towards the lateral side of the sole structure when pressure is applied to a medial portion of the foot support element.

7. The sole structure of claim 6, further comprising a ground facing element, wherein the slider element is sandwiched between the ground facing element and the foot support element.

8. The sole structure of claim 7, wherein at least one of the ground facing element or the foot support element comprises a gliding surface.

9. The sole structure of claim 1, further comprising:

at least one gliding surface which is tilted relative to a horizontal plane defined by the sole structure; and at least one pressure element which is configured to interact with the at least one gliding surface such that the slider element is caused to slide when pressure is applied to the sole structure.

10. The sole structure of claim 9, wherein at least one end of the slider element comprises the at least one gliding surface or the at least one pressure element.

11. The sole structure of claim 10, wherein a first end of the slider element comprises a first gliding surface and a second end of the slider element comprises a second gliding surface, wherein the first gliding surface is essentially flat and, wherein the second gliding surface comprises a concave shape.

12. The sole structure of claim 1, wherein the slider element is arranged in a forefoot portion of the sole structure corresponding to metatarsal fat pads.

13. The sole structure of claim 1, wherein the upper gliding element or the lower gliding element comprise at least one gliding surface which is tilted relative to a horizontal plane defined by the sole structure and configured to interact with a gliding surface or a pressure element of the slider element such that the slider element is caused to slide when pressure is applied to the sole structure.

14. The sole structure of claim 1, wherein the upper gliding element or the lower gliding element comprise at least one pressure element which is configured to interact with a gliding surface of the slider element such that the slider element is caused to slide when pressure is applied to the sole structure.

15. The sole structure of claim 1, wherein the pivot point is located more proximal to a medial side of the sole structure than to a lateral side.

16. The sole structure of claim 1, wherein the slider element comprises an aperture, and wherein the pivot point is arranged at least partially in the aperture.

17. A shoe comprising:

the sole structure of claim 1; and an upper coupled to the sole structure.

18. The shoe of claim 17, wherein the upper is coupled to either the upper gliding element or the lower gliding element.

19. A sole structure for a shoe, wherein the sole structure comprises:

a slider element configured to slide in a transverse direction of the sole structure, the slider element comprising an end, the end comprising:

at least one gliding surface tilted relative to a horizontal plane defined by the sole structure; and at least one pressure element which is configured to interact with the at least one gliding surface such that the slider element slides when pressure is applied to the sole structure;

wherein the slider element is configured to slide towards a medial side of the sole structure when pressure is applied to a lateral portion of the sole structure, wherein the slider element is configured to slide towards a lateral side of the sole structure when pressure is applied to a medial portion of the sole structure, and wherein the slider element sliding toward the medial side of the sole structure or the lateral side of the sole structure causes a tilting of a top surface of the sole structure with respect to a lower surface of the sole structure that defines a tilting angle, wherein a maximum tilting angle is greater than or equal to 5 degrees and less than or equal to 10 degrees.

* * * * *